United States Patent [19]

Glaese

[11] 4,323,234

[45] Apr. 6, 1982

[54] JUMP REACH PHYSICAL TRAINING SYSTEM

[76] Inventor: Edna R. Glaese, 2243 Lakeside Dr., Moses Lake, Wash. 98837

[21] Appl. No.: 182,977

[22] Filed: Sep. 2, 1980

[51] Int. Cl.[3] ..... A63B 5/16; G06G 1/02

[52] U.S. Cl. ..... 272/93; 33/494; 235/70 A; 116/335

[58] Field of Search ..... 272/100, 93, 101, 109; 273/1.5 A; 235/70 A, 70 R, 85 R; 116/DIG. 47, 335; 33/169 R, 494, 137; 434/199

[56] References Cited

U.S. PATENT DOCUMENTS

| | | | |
|---|---|---|---|
| 1,443,855 | 1/1923 | Swain | 434/199 |
| 1,706,510 | 3/1929 | Allen | 116/335 |
| 1,776,245 | 9/1930 | Barrett | 33/494 |
| 2,469,145 | 5/1949 | Baliff | 272/109 |
| 2,532,619 | 12/1950 | Heerich | 235/70 A |
| 2,602,233 | 7/1952 | Irving | 33/137 R |
| 3,006,644 | 10/1961 | Usher | 40/16.4 X |
| 3,258,266 | 6/1966 | Kamish | 273/1.5 A |
| 3,795,396 | 3/1964 | Kropelnitski | 272/100 |
| 3,837,569 | 9/1974 | Bradbury | 235/70 R |
| 4,208,050 | 6/1980 | Perrine | 273/1.5 A |

OTHER PUBLICATIONS

Flight Recorder, Advertizing Brochure of Questek Corp., Woodland Hills, CA, undated Jump & Reach Board.

*Primary Examiner*—Richard C. Pinkham

*Attorney, Agent, or Firm*—Wells, St. John & Roberts

[57] ABSTRACT

A jump and reach physical training system is disclosed for measuring vertical height attained by a person jumping vertically from a standing position. A board is included, having visually perceptible full size scale with equally spaced increments thereon. The board includes appropriate mounting devices that allow it to be attached to a support above the floor surface and within standing reach of the jumper. The jumper stands flat on the floor and extends her arms upwardly to reach a maximum height on the board. The maximum reached height is indicated by the increment covered by the fingertips. Such increment is recorded on a held calculator. The individual then jumps upwardly in an effort to cover the board at the highest increment possible. The attendant observed this and notes the increment adjacent the high point of the jumper's reach. A corresponding increment is noted on the calculator which then provides a direct reading in terms of standard linear measurement.

4 Claims, 6 Drawing Figures

JUMP REACH PHYSICAL TRAINING SYSTEM

BACKGROUND OF THE INVENTION

The present invention relates generally to physical training systems and more particularly to such systems used for measuring the vertical distance an individual is capable of jumping from a standing position.

A valuable procedure in overall training of athletes in sports or in general physical fitness involves measuring and recording individuals ability to jump upwardly from a standing position (commonly referred to as the "jump reach"). Repeated testing over a period of time produces valuable information about the jumper's progress in training and physical condition. The procedure is used often in primary, secondary and post graduate physical education, and especially in training for sports such as volleyball, basketball etc. where jumping capability is desired.

Though several forms of systems have been designed in the past to assist a trainer or coach in recording jump reach distances, the one most typically used involves measuring or mentally calculating the distance between a chalk mark made on a wall. One mark is made by the individual reaching as high as possible while standing. The individual then jumps upwardly to make another mark on the wall at the highest point of the jump. The jump reach distance measurement typically involves the use of a ruler or tape measure by the coach or trainer while standing on a ladder or chair next to the jumper. Such procedure is slow and tedious for the coach or trainer.

Additionally it is not safe for the individuals being tested to jump too close to a wall surface. Injuries are a common result when jumpers strike the wall surface or land awkwardly. It therefore becomes desirable to obtain some form of system by which "jump reach" distances may be quickly and accurately measured without requiring use of chalk by the jumper or requiring tedious calculations of the trainer.

There are several other known forms of systems designed to assist the trainer in recording jump reach distances. U.S. Pat. No. 3,258,266 to Kamish illustrates a jump indicator using an arrow to show the record keeper or trainer the peak reach of a jumper. A touch plate is then raised in increments from the peak reach point to determine the highest jump attainable. The jump is calculated by deducting the first measurement from the jump reach measurement. Several successive jumps may become necessary and the recorder must take a mathematical calculation for each individual jump.

U.S. Pat. No. 2,469,145 to Baliff discloses a jump measuring device. With the Baliff system the jumper first stands flat footed and reaches upwardly to touch the highest hinged plate within reach. Then, the jumper must shift position outwardly in order to jump upwardly to touch the plate at the peak of her jump. The jumper must be positioned nearly directly below the marker that indicates her highest jump. Otherwise, the jumper must reach laterally to touch the appropriate marker. Again, the trainer must make a mathematical calculation to determine the actual distance jumped between the standing reach position and the jump reach position.

U.S. Pat. No. 3,795,396 to Kropelnitski discloses another jump measuring device of a substantially complex configuration. Such device includes electromechanical drives and sprockets for indicating the highest jump attained. This device will not accurately measure the highest single jump unless the jumper reaches the height of a vertically adjustable touch plate. Again, the attendant must make mathematical calculations in order to determine the vertical jump distance.

In another system that is presently available commercially, a vertically adjustable board is mounted to a wall surface. The board is constructed of magnetic material and includes spaced increments between its top and bottom ends. A pair of magnets are used by the jumper. It is assumed that a first magnet is placed at a mark on the board adjacent to the highest reach attained while the user is standing erect. The second magnet is then placed on the board at the peak of the jump. Distance of the jump is then calculated by mathematical processes using numbers adjacent the magnets on the board Of the above devices, none provide an easily readable board surface that can be quickly and accurately read by a recorder watching a jumper, without requiring the use of some form of physical indicator on the board to show the highest point reached by the jumper. Additionally, no system known includes a calculator by which the recorder can quickly and accurately determine the vertical distance jumped without completing any mathematical computations whatever. The present system provides both of these features and, in addition, can be used away from walls or other surfaces that could cause injury to a jumper.

DETAILED DESCRIPTION OF A PREFERRED EMBODIMENT

Figure 1:
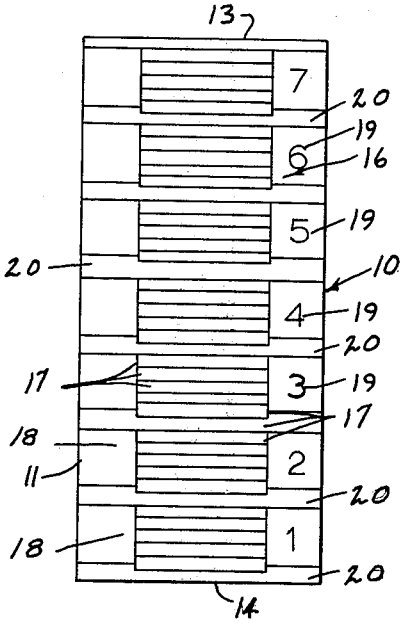
FIG. 1 is a front elevational view of a jump and reach board of the present system.
Figure 2:
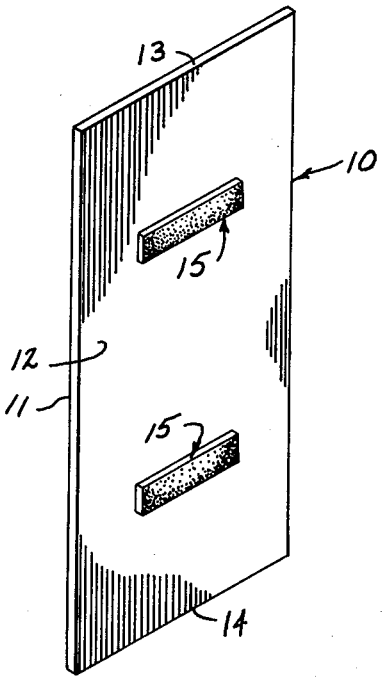
FIG. 2 is a pictorial view showing the backside of the board.

A system embodying the preferred form of the present invention includes two basic elements, a jump and reach board that is mountable to a support and a calculator that is to be held by a trainer, coach or recorder. The board and calculator used in conjunction accurately and quickly indicate the vertical distance attained by a jumper between the highest point reached by the jumper from a standing position and the highest point attained by jumping from the standing position.

The present jump and reach board is indicated in the drawings by the reference numeral 10. The board 10 includes a front surface 11 that is substantially flat and rectangular. The board also includes a back surface 12 and opposed end or top and bottom edges 13 and 14 respectively. A board mounting means 15 is provided on the board, preferably on the back surface 12. The mounting means 15 functions to releasably attach the board to a selected support (not shown). Preferably, the support is an object that is associated with the specific sport or exercise regimen. For example, the mounting means 15 can be utilized for attaching the board to a volleyball net or basketball hoop or backstop.

The mounting means 15 is described generally since it can be provided in several forms. For example, the mounting means may simply be comprised of a set of "Velcro" straps. Other forms of clamps, clips or straps securing apparatus well known and presently available may also be used.

The front surface 11 of the board is provided with a visually perceptable full size scale (indicia) as generally shown at 16. The scale 16 is provided in equally spaced horizontal increments 17 spaced vertically intermediate the top and bottom board edges 13 and 14 respectively. Preferably, the increments 17 are arranged in wide groups 18, each having an equal number of increments. Each of these groups 18 is labeled with an individual reference character 19. The groups 18 are separated by successive base lines 20.

It is preferred that the increments 18 of each group be individually color coded. This arrangement is best illustrated with reference to FIG. 4 wherein the various colors are indicated by standard color reference symbols. The base lines 20, for example, may be colored red. The succession of increments spaced upwardly from the red base lines 20 for each group may then be a succession of different colors. In the example shown in FIG. 4, the next successive increment upwardly from each base line 20 is colored white. The colors next in vertical succession are blue, yellow, green, and black. It is noted that each increment of a group is colored differently from the remaining increments of the group and that the increments of the several groups match one another.

Figure 4:
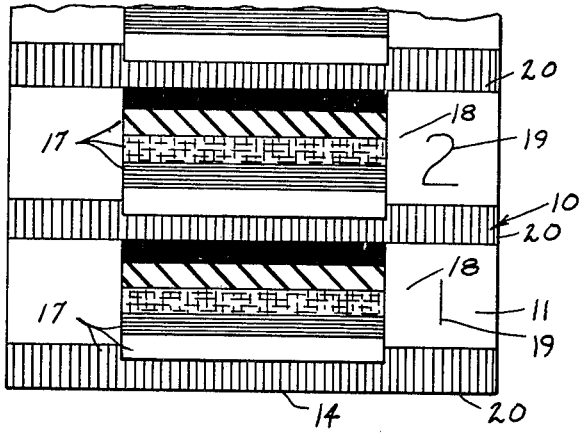
FIG. 4 is an enlarged fragmentary view of a portion of the board indicating the color sequence of the indicia increments thereon.
Figure 5:
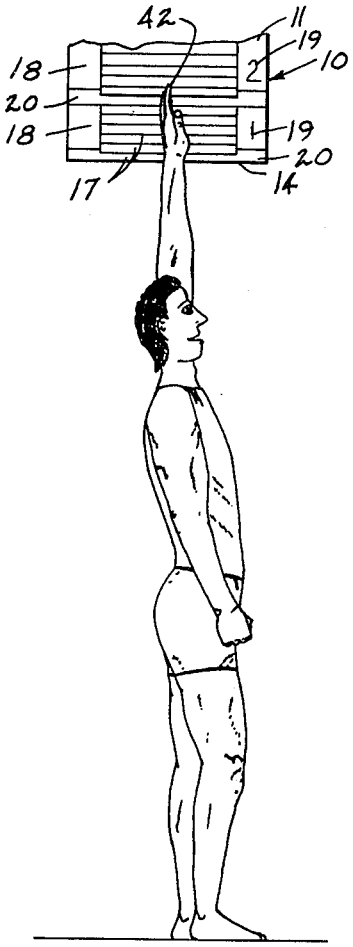
FIG. 5 is a diagrammatic view showing a jumper reaching to the board from a standing position.

It is understood that the color pattern shown in FIG. 4 and described above is given merely by way of example, it being understood that other variant colors and arrangements thereof can be used for indicating the various increments. It is important to note, however, that the colors of one group match the colored increments of the remaining groups. Therefore, an attendant need only recognize the reference character associated with a given group and one of the several colored increments associated with that group to record a specific elevation. With this arrangement, for example, the individual indicated in FIG. 5 is reaching to a point that may be referred to as 2-blue. The number "2" indicates the group reached and "blue" the colored increment reached within the group.

The scale 16 is provided in wide colored increments for the purpose of providing a sharp contrast between the various increments and between the board and the jumpers hand. The trainer or recorder is therefore capable of quickly and accurately observing the precise position of a jumper's hand in relation to the board.

Figure 3:
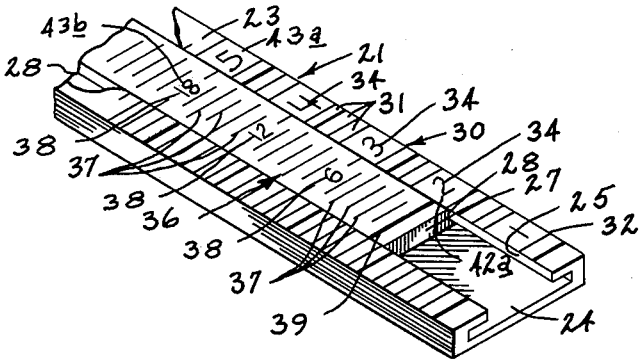
FIG. 3 is a fragmentary view of a calculator for the present system.

The second part of the present system is provided in the form of a computer means generally shown at 21 (FIG. 3). The computer means 21 is provided to automatically indicate to the recorder the vertical distance attained by a jumper without the necessity for the recorder performing mathematical calculations. Basically, the computer means 21 is used to record the height reached by the jumper while standing upright as shown in FIG. 5. Then, when the jumper leaps upwardly, the recorder is also able to note a relationship between the highest point reached by the jumper and a corresponding indicia on the computer. A numerical value in standard linear dimension is then automatically indicated by the computer means 21.

It is noted that several forms of computer means may be utilized. However, it is preferred that the computer be of a "slide rule" configuration as shown in FIG. 3. In this form, the computer means 21 includes a hand held base member 23 and an indicator member 27 movably mounted thereon. The base member 23 includes a longitudinal slot 24 defining a long reference edge 25 along one side thereof. The slot slidably receives the indicator member 27 which includes side edges 28 that slidably engage corresponding edges 25 of the slot. The two members 23 and 27 move relative to one another.

A first and second reduced size scales 30 and 36 are provided on the members 23 and 27 respectively. It is understood that the scales 30, 36 may be interchanged on the members 23 and 25. For example, the first reduced scale 30 may be provided on the indicator member 27 while the second reduced scale 36 may be provided on the base member 23. In the computer means shown, however, the first reduced scale 30 is provided on base member 23 and the second reduced scale 36 is presented on the indicator member 27.

The first reduced scale 30 includes a succession of equally spaced increments 31 divided into equally spaced groups 32. It is pointed out that the increments 31 and groups 32 correspond to the increments 17 and groups 18 on the board 10 but at a direct reduced proportion thereof. The individual groups 32 are distinguished by successive reference characters 34 that correspond to the reference characters 19 on the board. Thus, the exposed surface of the base member 23 is a scaled down version of the front surface of the board 10. The colors in each group of increments 31 match exactly the colors and grouping of the increments 17.

The second reduced scale 36 is provided on an exposed surface of the indicator member 27. The scale 36 is divided into equal increments 37, each of which is precisely equal to the corresponding increments 31 of the scale 30. The increments 37 are therefore directly proportional also to the increments of the scale 16 on board 10. The scale 36, however, is not subdivided into groups. The increments 37 are simply indicated by linear reference lines that are spaced in succession to one side of a base line 39.

Reference characters 38 (numbers) are included along the indicia 36 to indicate the distance (number of indicia spaces) from the adjacent reference line 37 to the base line 39. Such numbers 38 correspond to standard linear dimensions and to the spacing between successive colored increments on the board.

The increments reference lines extend laterally across the indicator member 27 and can be selectively positioned along the reference edge 25 adjacent a selected increment 31 of the first reduced scale 30.

Operation of the present system is extremely simple and efficient, resulting in fast, accurate measurements of the vertical distance jumped from a standing reference position.

Prior to operation, the board 10 is secured to a support, (not shown) such as a volleyball net, basketball hoop or other elevated support. This is accomplished by operation of the mounting means 15. The elevation of the board above a support surface such as a floor is determined by the average reach of the person or persons to be jumping. The board is preferably set at an elevation where the jumper can just reach the groups 18 indicated on the board by the reference characters "1" or "2".

A good position for the board is indicated in FIG. 5 where the jumper has reached the highest elevation 42 while standing erect. The point 42 corresponds to the group of increments indicated by the reference character "2" and a blue colored increment. The attendant can quickly recognize the elevational position of the jumper's hand and correspondingly set the base line 39 of the indicator 27 adjacent the corresponding group and increment 42*a* on the computer base. The mark or position 42*a* on the first reduced scale is noted by the recorder as being in the group number "2" and color increment blue. The computer means is thus set and is ready to automatically indicate the highest point attained by the jumper as he leaps upwardly.

Figure 6:
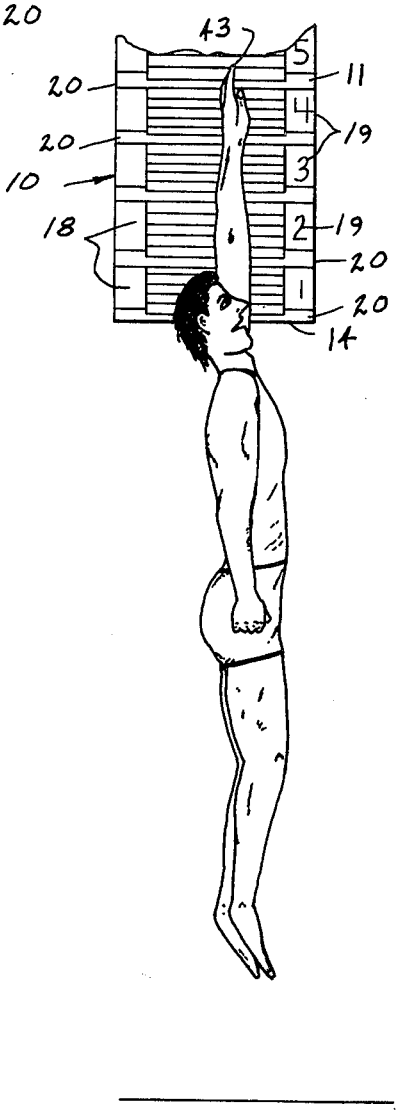
FIG. 6 is a diagrammatic view illustrating the jumper of FIG. 5 at the peak of the jump.

FIG. 6 illustrates the jumper at the highest elevation 43 attained during the leap from the standing position. Here, the recorder will quickly observe that the jumper's fingers have reached the increment group designated by the character "5" and the increment colored blue. This point is indicated on the full size scale in FIG. 6 at 43. The recorder then looks at the computer means to find group "5" and color blue on the first reduced scale 30. This point is indicated at 43*a* in FIG. 3. Directly across from this point 43*a* is a mark 43*b* corresponding to and directly indicating the jump distance attached. In this example, the distance jumped is directly read as 18 inches.

It may be noted from the above description that there is no requirement for the recorder to perform any mathematical computations but merely recognize the proper group and color successively reached by the jumper in the standing position and at the peak of the jump. This is easily accomplished as the colored indicia sharply contrasts with the jumper's hand. The results automatically provided by the computer can be recorded directly from the labeled increments 37.

The above description and attached drawings are given by way of example to set forth a preferred form of the present invention. Other forms and modifications may be made that fall within the scope of my invention as set forth in the following claims.

What I claim is:

1. A physical training system for measuring vertical distance jumped by an individual observed by a recorder between a reference point reached by the individual from an erect standing position adjacent an elevated support and the highest point observed by the recorder that is reached by the individual upon jumping upwardly, comprising:

a board having a front surface extending between end edges;

means on the board for attaching the board to the elevated support;

a visually perceptible full size scale on the front surface of the board arranged in vertical equally spaced successive groups of individual color coded increments with a reference character for each successive group, intermediate the end edges;

wherein the individual colored increments of one group match the colored increments of the remaining groups;

calculator means adapted to be held and operated by the recorder, including a base member and an indicator member mounted thereto, with a proportionally reduced scale on one of the members in generally spaced groups of increments of matching color and reduced proportion from the full size scale on the board and with reference characters thereon matching the reference characters on the board, for recording an increment corresponding to the increment on the board adjacent the reference point reached by the individual from the standing position, and for indicating to the recorder the vertical distance jumped as the recorder observes the highest increment on the board reached at the peak of the individual's jump and notes a corresponding increment on the calculator scale.

2. The system as claimed in claim 1 wherein the reduced scale is situated on said calculator base member along the reference edge thereof.

3. The system as claimed in claim 1 wherein the computer base is elongated and wherein the indicator member moves longitudinally and rectilinearly thereon.

4. The system as claimed by claim 1 wherein the increments of the full size scale are spaced evenly in standard increments of linear measurement and wherein corresponding increments of the reduced scale are spaced evenly in increments that are equal and reduced in proportion thereto.

* * * * *